US012103762B1

(12) United States Patent
Brown

(10) Patent No.: US 12,103,762 B1
(45) Date of Patent: Oct. 1, 2024

(54) SITE INSPECTION CASE

(71) Applicant: Lee Brown, Jensen Beach, FL (US)

(72) Inventor: Lee Brown, Jensen Beach, FL (US)

( * ) Notice: Subject to any disclaimer, the term of this patent is extended or adjusted under 35 U.S.C. 154(b) by 0 days.

(21) Appl. No.: 18/228,701

(22) Filed: Aug. 1, 2023

(51) Int. Cl.

| | |
|---|---|
| ***B65D 85/38*** | (2006.01) |
| ***B65D 25/28*** | (2006.01) |
| ***B65D 43/16*** | (2006.01) |
| ***B65D 43/22*** | (2006.01) |
| ***B65D 81/107*** | (2006.01) |

(52) U.S. Cl.
CPC ..... *B65D 85/38* (2013.01); *B65D 25/2841* (2013.01); *B65D 43/163* (2013.01); *B65D 43/22* (2013.01); *B65D 81/1075* (2013.01)

(58) Field of Classification Search
CPC .... B65D 85/38; B65D 81/1075; B65D 43/22; B65D 25/2841
USPC ..... 206/37.4, 320, 1.7, 570, 579, 569, 223, 206/562
See application file for complete search history.

(56) References Cited

U.S. PATENT DOCUMENTS 4,763,791 A * 8/1988 Halverson ..... A61C 9/00 433/37
4,830,579 A * 5/1989 Cheng ..... F04B 35/06 362/225
5,515,974 A * 5/1996 Higson ..... A61F 17/00 206/576
5,624,638 A * 4/1997 Negrotti ..... G09B 19/0069 206/229
5,848,700 A * 12/1998 Horn ..... A61F 17/00 206/572
6,454,097 B1 * 9/2002 Blanco ..... A45C 3/02 206/570
8,858,063 B1 * 10/2014 Agren ..... B65D 77/0446 604/82
11,547,616 B2 * 1/2023 Gerstner ..... A61H 31/005
2011/0011760 A1 * 1/2011 Habersetzer ..... G06F 1/1628 206/320
2012/0228189 A1 * 9/2012 Alhajri ..... G09B 23/00 206/569

* cited by examiner

*Primary Examiner* — Rafael A Ortiz

(57) ABSTRACT

A site inspection case is presented. The case includes a moisture detector port, configured for a moisture detector. The case also includes a surface hardness tester port, configured for a surface hardness tester. The case further includes a laser distance measurement device port, configured for a laser distance measurement device. The case additionally includes a wheeled distance measurement device port, configured for a wheeled distance measurement device. The case includes a plurality of surface coating vial ports, configured for a plurality of surface coating vials. The case also includes a plurality of sample tile ports, configured for a plurality of sample tiles. The case further includes energy absorbing foam in spaces external to the respective ports and internal to the case wherein the energy absorbing foam is formed with cavities to maintain the components within the interior of the case stowed within their respective ports.

5 Claims, 4 Drawing Sheets

SITE INSPECTION CASE

FIELD OF THE INVENTION

The present invention relates generally to cases, and more particularly, to site inspection cases, which utilize multiple individualized holding ports within the inspection cases to allow efficient and effective site assessments, with required instruments, and to minimize transmission of communicable diseases between job sites.

BACKGROUND OF THE INVENTION

Many methods and devices have been used unsuccessfully attempting to efficiently and effectively provide simple and easy to use systems, cases, and kits to minimize transmission of communicable diseases while providing personal onsite inspections by service professionals. Several devices, systems and methods have been created attempting unsuccessfully to address the problem of having service personnel making site visits to properly assess a site for proper surface protection design specifications, provide repeatable results, and prevent unwanted communicable disease transmission pathways for same onsite personnel and between different site locations.

Further, previous methods utilized to have complete equipment and instrument cases have been expensive and cumbersome to utilize. Quite often, extra personnel and additional equipment are needed to assess different sites which render the process more time-consuming and expensive.

Quite often, previous unsuccessful attempts of building and putting together a portable, compact, light weight site inspection case for site inspectors to carry out an efficient and effective site inspections resulted in multiple, bulky cases and components which rendered repeatability by different inspectors difficult.

Accordingly, there is an established need for site inspection cases which solve at least one of the aforementioned problems. Further, there is an established need for site inspection cases for surface protection design specialists which can be utilized more efficiently and effectively and provide repeatable results for a plurality of sites while minimizing transmission of communicable diseases.

SUMMARY OF THE INVENTION

The present invention is directed to innovative and cost-effective devices, systems, and cases for providing service professionals all required testing components, with discrete storage ports within a case for required testing samples, and auxiliary equipment and samples, in order to properly assess a site for surface protection design specification formulation. Further, the present invention is directed to innovative, ergonomically designed, covid protection cases which reduce physical contact between personnel and individual testing components and minimize transmission risk between different sites.

A site inspection case for surface protection design specialists is provided. The case includes a hardened exterior case with a handle. The hardened exterior case can include antimicrobial surfaces intended for minimization of transmission of communicable diseases. The case can include equipment, instrumentation, and material ports for storing necessary items within the case for use by surface protection design specialists when they are performing on site assessment. In embodiments, the case can include unique instrumentation, equipment, measuring devices, material samples, chemical reagents, and other surface protection design related items specifically designed to assist surface protection design specialists when they are performing on site assessments.

In another aspect a site inspection case, suitable for use as a portable hand carried site inspection case and configured for housing required site inspection equipment and materials is presented. The site inspection case comprising a case with a handle, the case including two folding halves, wherein the two folding halves are connected to each other with hinges on one end of the two folding halves, and wherein the two folding halves interconnect on another end of the two folding halves with a securing mechanism, and wherein the two folding halves enclose an interior of the case when the two folding halves are in a shut and secured position, and wherein the case is transportable by hand with a handle when the two folding halves are in a shut and secured position and the case is in a secured position with the securing mechanism, the interior of the case comprising a moisture detector port, wherein a moisture detector is storable within the moisture detector port, a surface hardness tester port, wherein a surface hardness tester is storable within the surface hardness tester port, a laser distance measurement device port, wherein a laser distance measurement device is storable within the laser distance measurement device port, a wheeled distance measurement device port, wherein a wheeled distance measurement device is storable within the wheeled distance measurement device port, a plurality of surface coating vial ports, wherein a plurality of surface coating vials are storable within the plurality of surface coating vial ports, a plurality of sample tile ports, wherein a plurality of sample tiles are storable within the plurality of sample tile ports, and wherein the interior of the case includes energy absorbing foam in spaces external to the respective ports, and wherein the energy absorbing foam is formed with cavities to maintain the components within the interior of the case securely stowed within their respective ports while the case is being transported and utilized.

In embodiments, a case comprising a plurality of flat wall component ports, wherein a plurality of flat wall components are storable within the plurality of flat wall component ports.

In embodiments, a case comprising a plurality of cabinetry component ports, wherein a plurality of cabinetry components are storable within the plurality of cabinetry component ports.

In embodiments, a case comprising a portable computing tablet port, wherein a portable computing tablet is storable within the portable computing tablet port.

In embodiments, a case comprising a wire brush port, wherein a wire brush is storable within the wire brush port.

In embodiments, the system ca include an inspection kit for performing site inspections for surface design protection systems for storing into a portable site inspection case. The inspection kit comprising a laser distance measuring device; a wheeled distance measuring device; a surface hardness testing device; a plurality of surface coating vials; a plurality of sample tiles of standardized design compositions; and a ground moisture measurement device.

In embodiments, a kit comprising a plurality of flat wall components.

In embodiments, a kit comprising a plurality of cabinetry components.

In embodiments, a kit comprising a portable computing tablet.

In embodiments, a kit comprising a wire brush.

In embodiments, the system and/or case can include foam inserts with unique dimension cutouts customized to house specialized testing apparatus, sample tiles, hardness testing instruments, distance measurement devices, epoxy coating application vials, poly urethane coating vials, Polyaspartic coating vials, anti-slip coating vials, mobile devices, tablets, iPad® devices, and/or fixture samples.

In embodiments, the case can include cavities for system components to be housed.

In embodiments, the case can include cavities with unique discrete dimensions that hold and store equipment, devices, materials, in order to assist the technician to perform onsite inspections.

In embodiments, the case can include cavities with interior surfaces designed to provide sufficient static friction to hold in place system and/or case components within the cavities and also designed such that the static friction coefficients are at level which allow a site inspector to insert and remove system and/or case components with relative ease utilizing a normal human finger pressure and normal grabbing/grasping exertion of two fingers into and out of the cavities.

In embodiments, the system and/or case can include cavity dimensions which can be configured to allow portions of a plurality of components housed and/or stored in a case and/or foam inserts to be positionable such that an upper portion of the components can be effectively grabbed with normal exertion with two fingers and be removed and reinserted into cavities.

In embodiments, the case can include a concrete moisture meter, such as but limited to a tramex moisture meter. The tramex moisture meter can be configured to measure moisture percentage in parts of the floor and the measurements can be used as input into the surface protection design program in order to establish design parameters.

In embodiments, the case can include wood, drywall, and/or concrete moisture meters.

In embodiments, the case can include a hardness measurement kit, such as a Mohs hardness testing kit and/or a diamond cast kit.

In embodiments, the case can include a set of pins that measures the hardness of the surface.

In embodiments, the case can include measuring devices which measure surface hardness testers in order to properly spec out the surface covering.

In embodiments, the case can include mechanisms to scratch surfaces in order to obtain a hardness measurement.

In embodiments, the case can include an off the shelf hardness testing kit.

In embodiments, the case can include vials in the kit, wherein the vials contain testing mixtures.

In embodiments, the case can include a vial of flake samples.

In embodiments, the case can include a vial of ox bite.

In embodiments, the case can include a vial with anti-slip additive.

In embodiments, the case can include a laser measurement device.

In embodiments, the case can include a vial with Polyaspartic solution.

In embodiments, the case can include cutouts for pieces of a flat wall or store wall.

In embodiments, the case can include pieces of PVC that you hang on a wall with grooves to hang tools.

In embodiments, the case can include cavities for vials of epoxy surface.

In embodiments, the case can include a vial cavity open to put another base coat or alternative coat or poly hard coat mix into.

In embodiments, the case can include a flat wall which can be cut into pieces.

In embodiments, the case can include a big sheet of a flat wall which is cut into smaller pieces and those flat-wall pieces can be stored in the case.

In embodiments, the case can include a groove designed for storing comparison tiles.

In embodiments, the case can include cabinetry stored colors, for comparison purposes.

In embodiments, the case can include a space for a flaked tile sample to show color, blend.

In embodiments, the case can include cavities to store at least 5 color tiles.

In embodiments, the case can include a sixth cavity wherein the 6th one is the gray one, and the kill tile is epoxy.

In embodiments, the case can include dimensions of the slots that are matched to the custom-made tile samples.

In embodiments, the case dimensions can be important for the tile slots, wherein the tile slots can store a plurality of tiles for different surfaces and colors.

In embodiments, the case can include sample tiles with different finishes matte or gloss finish.

In embodiments, the case can include a top side, wherein the top side of the case can include cavities for cabinetry tile, large surface composite mixture tiles.

In embodiments, the case can include foam material wherein cavities are formed within the foam material and wherein the cavities include dimensions configured to securely store and keep in place within the cavities' devices, materials, instruments, testers, vials, measuring apparatus, and/or equipment suitable for use by a site inspector.

In embodiments, the case can include on a left-hand side a space for cabinetry tiles.

In embodiments, the case can include a larger cavity, the cavity configured to include storage space for one, two, or three large tiles.

In embodiments, the cavity can include small straps to allow the samples to be pulled out one by one.

In embodiments, the system can include dimensions of inner case foam, cushion foam, rubber, expansion poly, Styrofoam, molded synthetic material, bubble wrap, and/or Expanded polyethylene foam cutouts which can be configured to keep the tiles in place, so they stay in place while the case is being transported.

In embodiments the case can include Expanded polyethylene foam.

In embodiments, the system can include one strap for each tile layer.

In embodiments, the case can include a storage space configured for just one tile.

In embodiments, the case can include dimensions of a large tile cavity which can big enough to allow an overall color pattern and flake design and percentage fill of different colors to be visible to a person with 20/20 eyesight at a distance of 6 feet when looking at the tile straight on.

In embodiments, the case can include tiles with standards to show standard percentages of mixes for end users to visually discern from one another.

In embodiments, the system can include tiles with a predetermined blend in the ox application.

In embodiments, the system can include tiles for comparison and for designing color and design match coordinates with the ox application standard mixes.

In embodiments, the system can include tile sample slots, the tile sample slots can be configured to be large enough to show an overall pattern and adequately shows the intermixing of the different variables.

In embodiments, the system can be designed to allow the color schemes and pattern design.

In embodiments, the system can include an upper half of the case on the left-hand side a thin tile, and cutout to allow the bottom side of a thin tile not to impinge on system components on a lower side of the case.

In embodiments, the system can include a moisture meter and vials in about the middle of the case.

In embodiments, the case can include a thumb cutout which can be embedded in the support foam to allow an iPad or tablet to sit on top of the vials and the moisture meter to allow the site inspector to have an iPad or tablet to be transported and be a part of the case.

In other embodiments the case can include a compact version to have a reduced size and weight to allow the inspector to reduce overall carrying weight of material while transporting the case between locations.

In embodiments, the system can include case and/or cases with reduced weight and reduced size.

In embodiments, the system can include cavities for four different vials.

In embodiments, the system can include a case wherein a sales rep can take a couple of blend tiles and a large 4 ft tall tile to show for comparison purposes.

In embodiments, the system can include slots for 10 different tiles for comparison purposes.

In embodiments, the system can include slots on a left-hand side for pool decks.

In embodiments, dimensions can include a size of the slots is unique set by OX DEALER.

In embodiments, the system and include dimensions which are picked to allow for a large enough area to be shown to allow the sample tiles to illustrate the features of the design patterns.

In embodiments, the system and/or case can include dimensions including, but not limited to:

Site Inspection Case Dimensions
- Length 24.76"
- Depth 8.24"
- Width 15.46"

Measure Wheel Head Slot Specs
- Length 4"
- Depth 4"
- Width 6.1"

Measure Wheel Handle Slot Length
- 15.75"
- Depth 2.5"
- Width 1.3"

Vial Slot Length
- 1.3"
- Width 1.3"
- Depth 2.7"

Laser Measure Slot
- Length 4.61"
- Depth 1.00"
- Width 1.4"
- Thumb Slot 0.3"

Moisture Meter Length
- 6.5"
- Depth 1.5"
- Width 3.83"
- Thumb slot 0.3"

Moisture Metter Probe Slot Length
- 0.8"
- Depth 1.5"
- Width 2.00"

Display Tiles Slots
- Length 4.8"
- Depth 4.00"
- Width 0.25"

Wire Brush Head Slot Length
- 1.56"
- Depth 3.5"
- Width 3.00"

Wire Brush Handle Slot
- Length 1.00"
- Depth 1.75"
- Width 3.52"

In embodiments, tile slots depths can be designed to be 3 and ¾ inch depth because it may be desired to allow 1 and ¼ inch tile to stick out to make it easy to pull tiles out of the case.

These and other objects, features, and advantages of the present invention will become more readily apparent from the attached drawings and the detailed description of the preferred embodiments, which follow.

BRIEF DESCRIPTION OF THE DRAWINGS

The features and advantages of the present invention will be better understood when the Detailed Description of the Preferred Embodiments given below is considered in conjunction with the figures provided.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
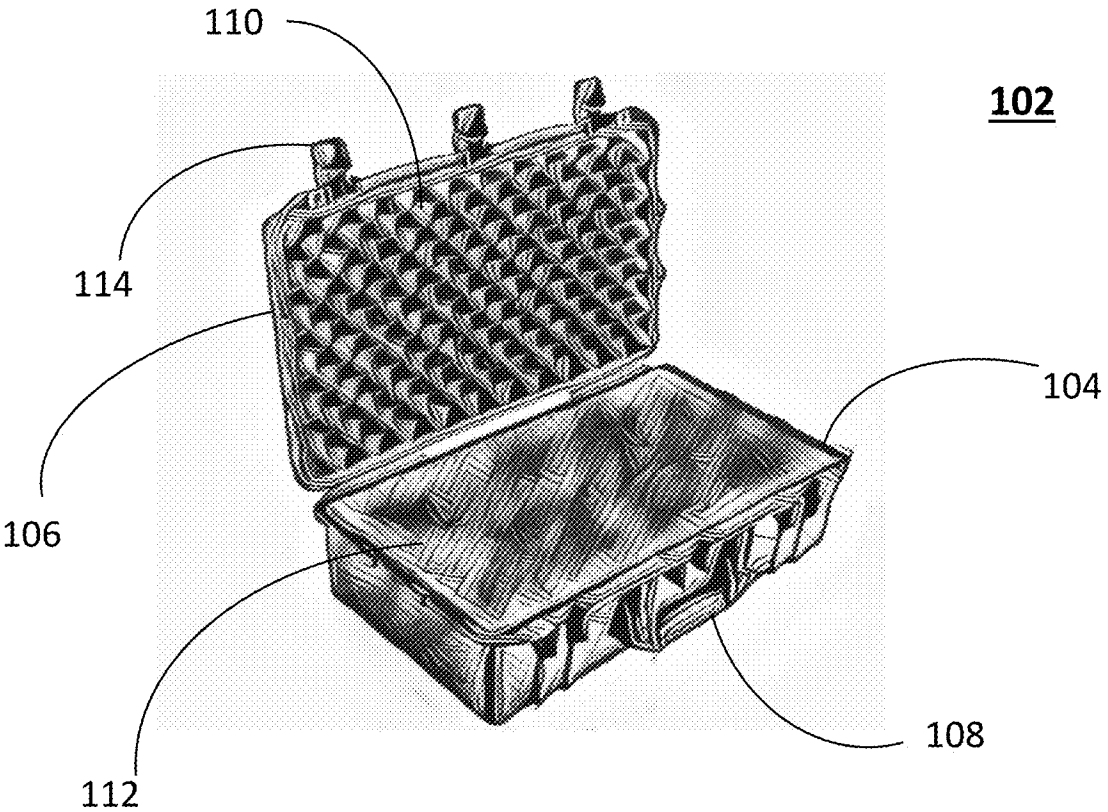
FIG. 1 is a top perspective view of an embodiment of a site inspection case showing the case in an open position.

As shown in FIG. 1, the system can include a case 102 having a lower half 104 and an upper half 106 and wherein the case 102 can include a handle 108 for portability. The case 102 can include an upper foam insert 110 and a lower foam insert 112.

Figure 2:
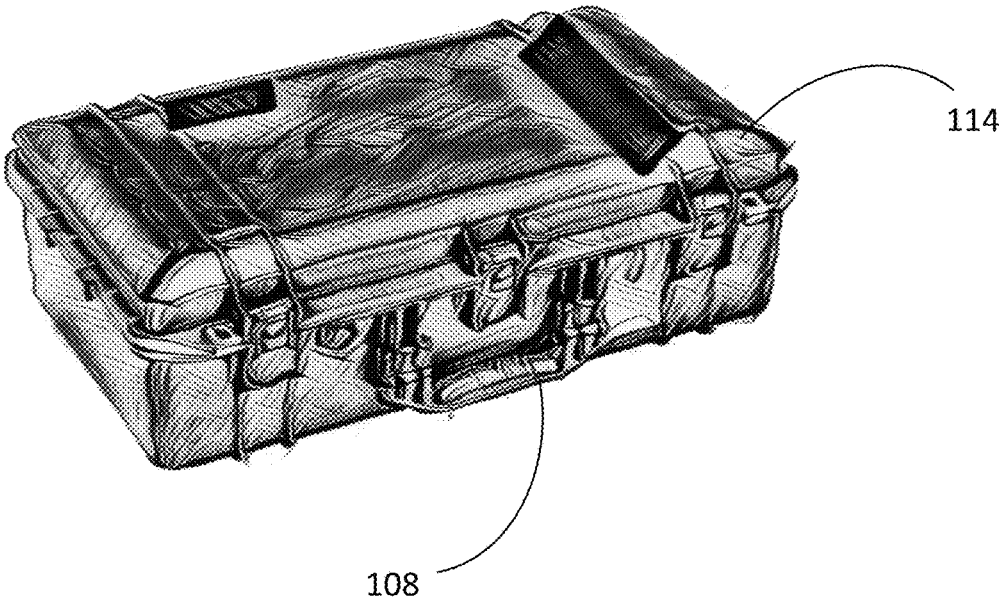
FIG. 2 is a top perspective view showing an embodiment of a site inspection case showing the case in a closed position.

As best seen in FIG. 2, the case 102 can be closed and secured for transportation with securing clamps 114.

Figure 3:
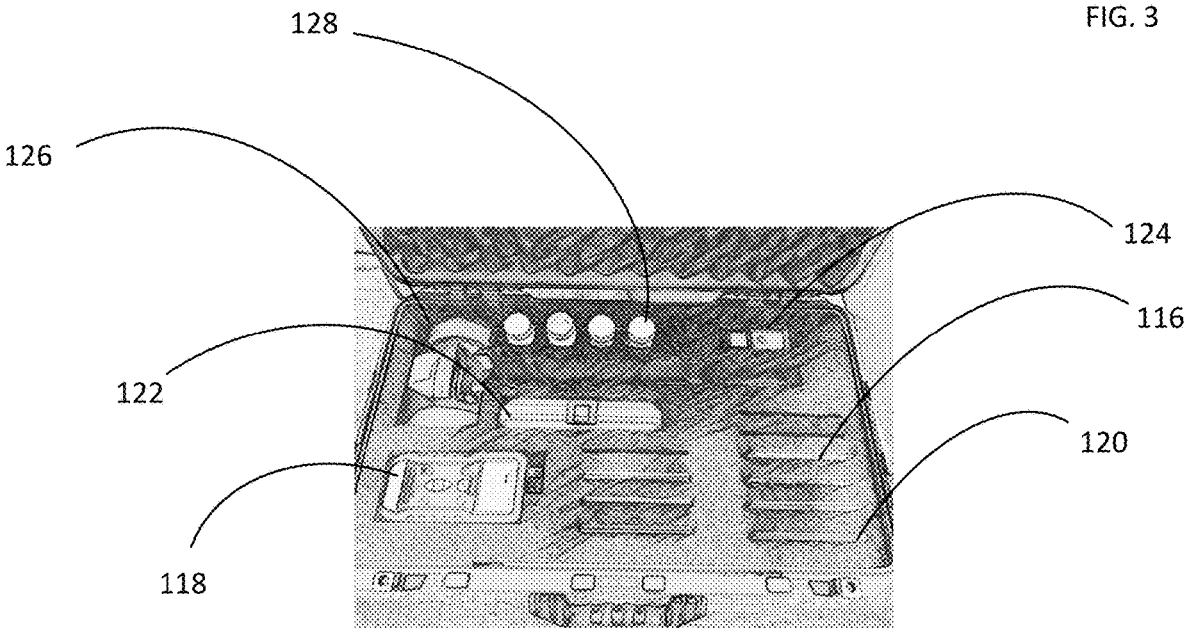
FIG. 3 is a top perspective showing an embodiment of a site inspection case showing a plurality of components housed within.

Turning to FIG. 3, the case 102 can include a plurality of cavities 116 configured for a plurality of dimensions to house a plurality of case components. The case can include a cavity for a moisture analyzer 118. The case can also include cavities for a plurality of custom dimensioned sample tiles 120. The case can also include a cavity for a hardness tester 122. The case can further include a cavity for a laser measurement device 124. The case can also include a cavity for a wheeled measurement device 126. The case can also include cavities for a plurality of surface coating vials 128.

Figures 3, 4:
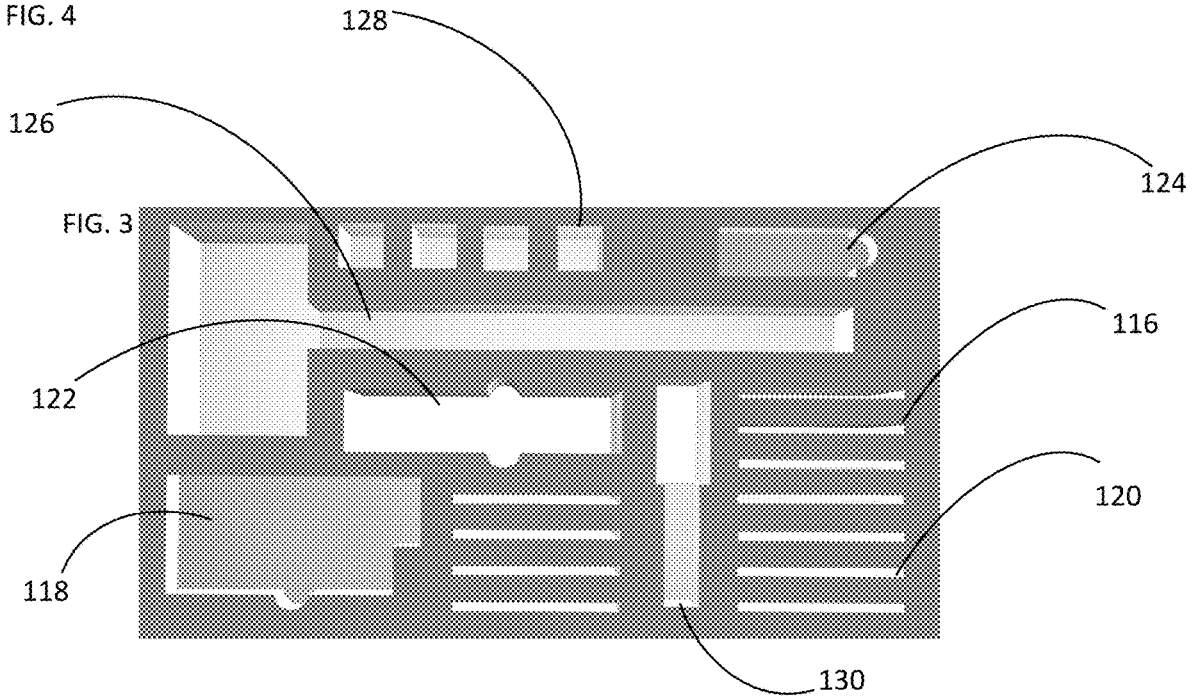
FIG. 4 is a top view of a plurality of cavities within an inner foam insert in an inspection case in an embodiment of the present invention.

Turning to FIG. 4, The case can further include a cavity for components such as a wire brush 130.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

The present invention has been described with reference to the preferred embodiments, it should be noted and understood that various modifications and variations can be crafted by those skilled in the art without departing from the scope and spirit of the invention. Accordingly, the foregoing disclosure should be interpreted as illustrative only and is not to be interpreted in a limiting sense. Further it is intended that any other embodiments of the present invention that result from any changes in application or method of use or operation, method of implementation which are not specified within the detailed written description or illustrations contained herein are considered within the scope of the present invention.

Insofar as the description above and the accompanying drawings disclose any additional subject matter that is not within the scope of the claims below, the inventions are not dedicated to the public and the right to file one or more applications to claim such additional inventions is reserved.

What is claimed is:

1. A site inspection case, suitable for use as a portable hand carried site inspection case and configured for housing required site inspection equipment and materials, the site inspection case comprising:

a case with a handle, the case including two folding halves, wherein the two folding halves are connected to each other with hinges on one end of the two folding halves, and wherein the two folding halves interconnect on another end of the two folding halves with a securing mechanism, and wherein the two folding halves enclose an interior of the case when the two folding halves are in a shut and secured position, and wherein the case is transportable by hand with the handle when the two folding halves are in a shut and secured position and the case is in a secured position with the securing mechanism, the interior of the case comprising a moisture detector inserted within a moisture detector port, wherein the moisture detector is storable within the moisture detector port, a surface hardness tester inserted within a surface hardness tester port, wherein the surface hardness tester is storable within the surface hardness tester port, a laser distance measurement device port, wherein a laser distance measurement device is storable within the laser distance measurement device port, a wheeled distance measurement device port, wherein a wheeled distance measurement device is storable within the wheeled distance measurement device port, a plurality of surface coating vial ports, wherein a plurality of surface coating vials are storable within the plurality of surface coating vial ports, a plurality of sample tiles inserted within a plurality of sample tile ports, wherein the plurality of sample tiles are storable within the plurality of sample tile ports, and wherein the plurality of sample tile ports are configured to allow 1¼ inch of tops of the plurality of sample tiles to remain above a top of the plurality of sample tile ports;

and wherein the interior of the case includes energy absorbing foam in spaces external to the respective ports, and wherein the energy absorbing foam is formed with cavities to maintain the components within the interior of the case securely stowed within their respective ports while the case is being transported and utilized.

2. The case as recited in claim 1, further comprising a plurality of flat wall component ports, wherein a plurality of flat wall components are storable within the plurality of flat wall component ports.

3. The case as recited in claim 1, further comprising a plurality of cabinetry component ports, wherein a plurality of cabinetry components are storable within the plurality of cabinetry component ports.

4. The case as recited in claim 1, further comprising a portable computing tablet port, wherein a portable computing tablet is storable within the portable computing tablet port.

5. The case as recited in claim 1, further comprising a wire brush port, wherein a wire brush is storable within the wire brush port.

* * * * *